US009033291B2

(12) United States Patent
Branham et al.

(10) Patent No.: US 9,033,291 B2
(45) Date of Patent: May 19, 2015

(54) PLASTIC STORAGE BAG HOLDER

(76) Inventors: Michael James Branham, Junction, UT (US); Cara Darlene Hershberger, Rock Spring, WY (US)

( * ) Notice: Subject to any disclaimer, the term of this patent is extended or adjusted under 35 U.S.C. 154(b) by 158 days.

(21) Appl. No.: 13/324,898

(22) Filed: Dec. 13, 2011

(65) Prior Publication Data

US 2013/0146722 A1 Jun. 13, 2013

(51) Int. Cl.
*B65B 67/12* (2006.01)

(52) U.S. Cl.
CPC ..... *B65B 67/1205* (2013.01); *B65B 67/1211* (2013.01); *B65B 67/12* (2013.01); *B65B 67/1233* (2013.01)

(58) Field of Classification Search
CPC B65B 67/12; B65B 67/1205; B65B 67/1211; B65B 67/1233; B65F 1/06
USPC ..... 248/97, 99, 100, 101
See application file for complete search history.

(56) References Cited

U.S. PATENT DOCUMENTS

| | | | | | |
|---|---|---|---|---|---|
| 733,449 | A | * | 7/1903 | Willsie | 141/75 |
| 1,135,892 | A | * | 4/1915 | Grosenbeck | 220/9.3 |
| 1,181,829 | A | * | 5/1916 | Bower | 220/9.3 |
| 1,194,680 | A | * | 8/1916 | Studebaker | 220/6 |
| 1,738,017 | A | * | 12/1929 | Phillips | 4/488 |
| 2,470,271 | A | * | 5/1949 | Steinbacher | 248/97 |
| 2,639,110 | A | * | 5/1953 | Nicolas | 248/99 |
| 2,875,970 | A | * | 3/1959 | Gardner | 248/101 |
| 3,388,882 | A | * | 6/1968 | Burroughs et al. | 248/97 |
| 3,603,541 | A | * | 9/1971 | Sturm et al. | 248/97 |
| 3,614,042 | A | | 10/1971 | Jensen | |
| 3,908,564 | A | * | 9/1975 | Miller et al. | 108/162 |
| 4,322,048 | A | | 3/1982 | Vollman | |
| 4,509,570 | A | * | 4/1985 | Eby et al. | 141/390 |
| 4,623,111 | A | | 11/1986 | Prader | |
| 4,667,912 | A | * | 5/1987 | DeVilbiss | 248/97 |
| 4,757,966 | A | | 7/1988 | Harris | |
| 4,783,031 | A | * | 11/1988 | Ebentheuer | 248/97 |
| 4,802,647 | A | * | 2/1989 | Celmayster et al. | 248/544 |
| 4,815,866 | A | * | 3/1989 | Martone | 383/34.1 |
| 4,874,141 | A | | 10/1989 | Schulz | |
| 4,953,815 | A | | 9/1990 | Beymer | |
| 4,981,274 | A | * | 1/1991 | McVay et al. | 248/99 |
| 5,190,253 | A | | 3/1993 | Sable | |
| 5,639,050 | A | | 6/1997 | Peterson | |
| 5,738,314 | A | | 4/1998 | Davis | |
| 5,797,567 | A | | 8/1998 | Magnafici | |
| 5,799,908 | A | | 9/1998 | Downs | |

(Continued)

FOREIGN PATENT DOCUMENTS

| | | | |
|---|---|---|---|
| AU | 645953 B | * | 1/1994 |
| DE | 19858177 A1 | * | 6/2000 |

(Continued)

*Primary Examiner* — Terrell McKinnon
*Assistant Examiner* — Eret McNichols
(74) *Attorney, Agent, or Firm* — Stephen J. Stark

(57) ABSTRACT

A bag holder for allowing a person to easily fill a plastic storage bag without the help of an additional person to hold the plastic storage bag open. The bag holder includes a first support, a second support, upper arms connecting the top ends of the first support with the second support, lower supports connecting the bottom ends of the first support with the second support, and clamps positioned opposed to one another, the clamps are secured to at least one of the first upper arm, the second upper arm, and the middle section of the first support and the second support.

9 Claims, 2 Drawing Sheets

(56) References Cited

U.S. PATENT DOCUMENTS

| | | | | |
|---|---|---|---|---|
| 5,921,512 | A | 7/1999 | Torres | |
| 6,059,126 | A * | 5/2000 | Miller | 211/85.15 |
| 6,116,549 | A | 9/2000 | Santa Cruz | |
| 6,394,400 | B1 | 5/2002 | Sontag | |
| 6,508,443 | B1 | 1/2003 | Andreasson | |
| 6,543,732 | B1 | 4/2003 | Yuan | |
| 6,698,474 | B1 | 3/2004 | Trsek | |
| 6,971,611 | B2 | 12/2005 | Folkmar | |
| 7,036,676 | B2 * | 5/2006 | Christensen | 220/565 |
| 7,318,569 | B1 | 1/2008 | Bilotta | |
| D610,768 | S * | 2/2010 | Elden Limb | D34/6 |
| 7,806,594 | B2 | 10/2010 | Trinko | |
| 7,810,766 | B2 | 10/2010 | Blessman | |
| 7,938,291 | B2 * | 5/2011 | Christensen | 220/666 |
| 8,292,239 | B1 * | 10/2012 | Elden Limb | 248/97 |
| 8,322,663 | B2 * | 12/2012 | Bosik | 248/97 |
| 8,662,459 | B2 * | 3/2014 | Truitt | 248/171 |
| 8,857,772 | B1 * | 10/2014 | Weldon | 248/97 |
| 2009/0001230 | A1 | 1/2009 | Hall | |
| 2009/0313951 | A1 | 12/2009 | Hanson | |
| 2010/0123051 | A1 * | 5/2010 | Astwood | 248/100 |
| 2010/0314507 | A1 | 12/2010 | Laitila | |
| 2012/0001035 | A1 * | 1/2012 | Michel | 248/97 |
| 2012/0325984 | A1 * | 12/2012 | Moynihan et al. | 248/98 |
| 2013/0001377 | A1 * | 1/2013 | Reiss | 248/97 |
| 2013/0270401 | A1 * | 10/2013 | Horvath | 248/97 |
| 2014/0151515 | A1 * | 6/2014 | Andersen | 248/97 |

FOREIGN PATENT DOCUMENTS

| | | | |
|---|---|---|---|
| GB | 2488544 | A * | 9/2012 |
| JP | 2000025904 | A * | 1/2000 |

* cited by examiner

PLASTIC STORAGE BAG HOLDER

BACKGROUND OF THE INVENTION

The present invention generally relates to plastic bag holding devices. More particularly, the present invention relates to plastic storage bag holders for supporting the plastic storage bag in an opened position to facilitate the filling of the bag.

The use of plastic storage bags to store solid and liquid foods has increased through the years. Plastic storage bags offer an easy alternative to store food items without having to clean the container. Unfortunately, plastic storage bags are made of flexible material which makes it difficult for one person alone to maintain the plastic storage bag in a wide-open configuration during the filling of the bag.

As can be seen, there is a need for an easy to use device that allows a person to easily fill the plastic storage bag without an additional person to hold the bag open.

SUMMARY OF THE INVENTION

In one aspect of the present invention, a bag holder includes a first support having a top end, a bottom end, and a middle section; a second support having a top end, a bottom end, and a middle section; a first upper arm connecting the top end of the first support with the top end of the second support; a second upper arm connecting the top end of the first support with the top end of the second support; a first lower support connecting the bottom end of the first support with the bottom end of the second support; a second lower support connecting the bottom end of the first support with the bottom end of the second support; and clamps positioned opposed to one another, the clamps are secured to at least one of the first upper arm, the second upper arm, and the middle section of the first support and the second support.

In another aspect of the present invention, a bag holder includes a first support having a top end, a bottom end, and a middle section; a second support having a top end, a bottom end, a middle section; at least one relief cut located on each one of the top ends of the first support and the second support; a first upper arm connecting the relief cut of the top end of the first support with the top end of the second support; a second upper arm connecting the relief cut of the top end of the first support with the top end of the second support; a first lower support connecting the bottom end of the first support with the bottom end of the second support; a second lower support connecting the bottom end of the first support with the bottom end of the second support; clamps positioned opposed to one another, the clamps are secured to at least one of the first upper arm, the second upper arm, and the middle section of the first support and the second support; the first upper arm and the second upper arm pivot against the relief cut to move the bag holder from an opened position to a folded position; the first lower support and the second lower support pivot against the bottom ends of the first support and the second support to move the bag holder from the opened position to the folded position.

These and other features, aspects and advantages of the present invention will become better understood with reference to the following drawings, description and claims.

DETAILED DESCRIPTION OF THE INVENTION

Figure 1:
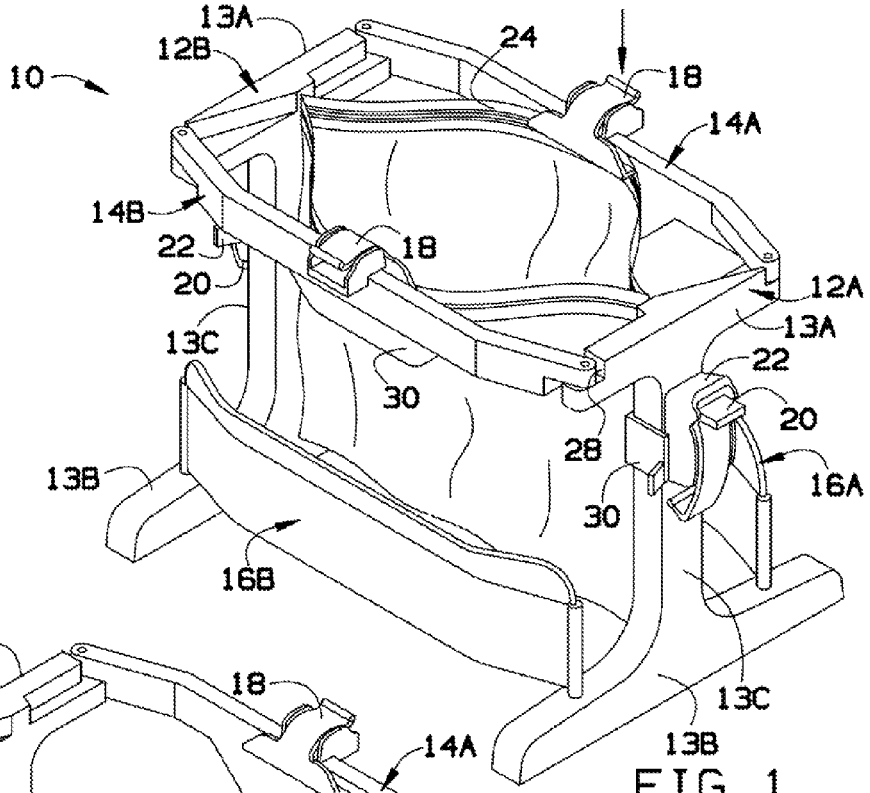
FIG. 1 is a perspective front view of a bag holder according to an exemplary embodiment of the present invention showing the bag holder being used with a large plastic storage bag.
Figure 2:
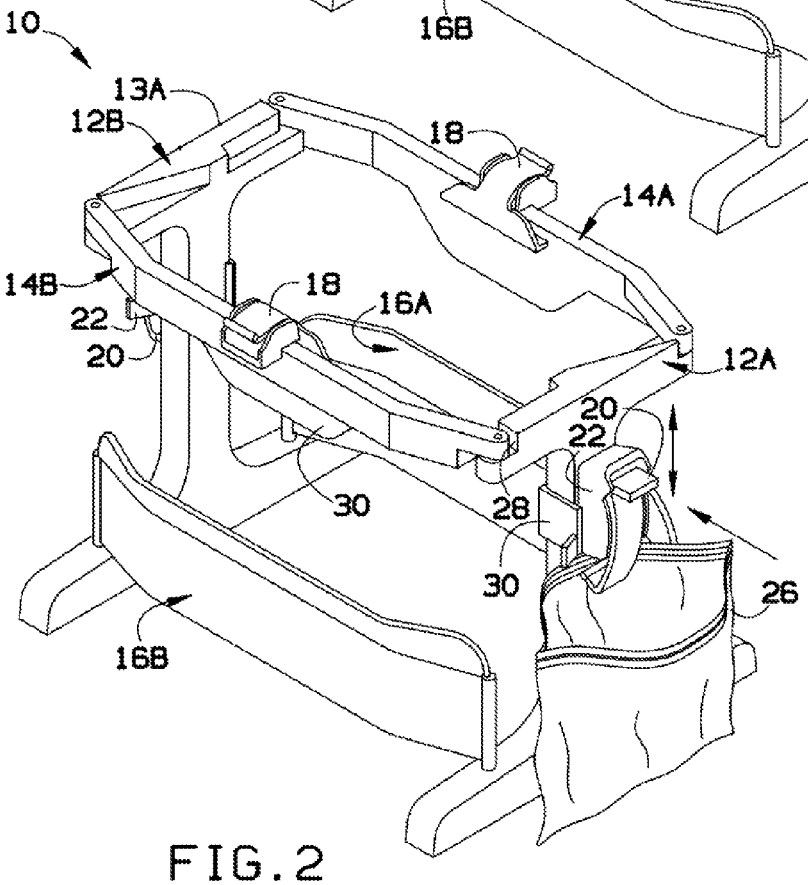
FIG. 2 is a perspective front view of the bag holder of FIG. 1 showing the bag holder being used with a small plastic storage bag.
Figure 3:
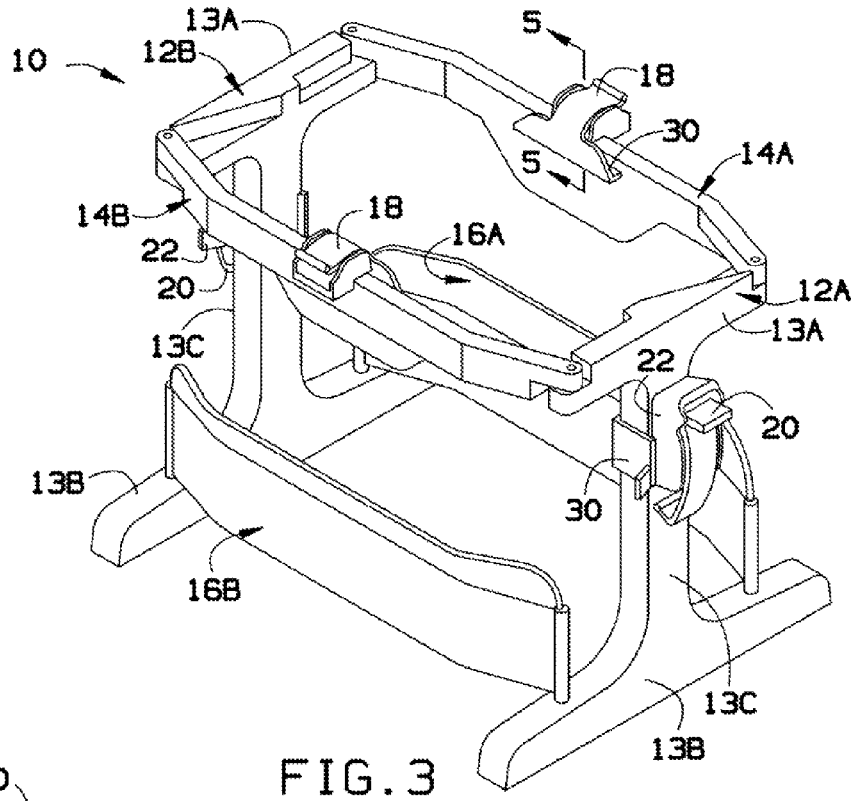
FIG. 3 is a perspective front view of the bag holder of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a bag holder for allowing a person to easily fill a plastic storage bag without the help of an additional person to hold the plastic storage bag open.

FIGS. 1-5 show a bag holder 10 according to an exemplary embodiment of the present invention. The bag holder 10 may provide support to large plastic storage bags 24 as well as to small plastic storage bags 26. The bag holder 10 may hold the plastic storage bags 24, 26 wide open so that contents, for example, a food item (not shown) may be easily poured into the plastic storage bags 24, 26. In addition, the bag holder 10 may allow the user (not shown) to easily remove the plastic storage bags 24, 26 from the bag holder 10. The bag holder 10 may be made of a sturdy material, for example, hard plastic, metal, composite, wood, or resin.

The bag holder 10 may include a first support 12*a* and a second support 12*b*. The first support 12*a* and the second support 12*b* may be shaped as an inverted capital letter T, as a capital letter I, or as a capital letter H. Each one of the first support 12*a* and the second support 12*b* may include a top end 13*a*, a bottom end 13*b*, and a middle section 13*c*. The length of the top end 13*a* may be smaller than the length of the bottom end 13*b* to keep the bag holder 10 in a stable upright position. The size and shape of each top end 13*a* may be, for example, between approximately 5 and 8 inches in length. The size and shape of each bottom end 13*b* may be, for example, between approximately 7 and 10 inches in length. The height and width of the middle section 13*c* may depend on the length of the top end 13*a* and the length of the bottom end 13*b*. The middle section 13*c* may have, for example, between approximately 7 and 9 inches in length and between approximately ½ and 1½ inches in width.

A first upper arm 14*a* and a second upper arm 14*b* may connect the first support 12*a* with the second support 12*b*. The first upper arm 14*a* and the second upper arm 14*b* may provide the general length to the bag holder 10. The first upper arm 14*a* and the second upper arm 14*b* may be support for the upper portion of the large plastic bag 24 while being filled. The first upper arm 14*a* and the second upper arm 14*b* may be pivotably attached to the ends of each one of the supports 12*a*, 12*b*. The first upper arm 14*a* and the second upper arm 14*b* of the bag may have a length, for example, between approximately 8 and 12 inches and a width, for example, between approximately ¼ and ¾ inches. The first upper arm 14*a* and the second upper arm 14*b* may include an angled portion of, for example, between 15 to 30 degrees. In some embodiments, the angled portion may be at a 20 degree angle. The angled portion may allow the bag holder 10 to be folded for easier storage.

A first lower support 16*a* and a second lower support 16*b* may connect the first support 12*a* with the second support 12*b*. The first lower support 16*a* and the second lower support 16*b* may firmly hold the bottom of the large plastic storage bag 24 in position during the filling of the large plastic bag 24. The first lower support 16*a* and the second lower support 16*b* may be pivotably attached to the ends of each one of the supports 12*a*, 12*b*. The size of the first lower support 16*a* and the second lower support 16*b* may depend on the size of the upper arms 14*a*, 14*b* to keep the plastic storage bag holder 10 at a vertical position without binding when being folded for storage. The first lower support 16*a* and the second lower support 16*b* may have, for example, approximately 2½ inches in height and approximately 9¾ inches in length. Pins (not shown) may be secured to each end of the first lower support 16*a* and the second lower support 16*b*. The pins (not shown) may protrude from the first lower support 16*a* and the second lower support 16*b* and fit into the holes (not shown) on the bottom ends 13*b* providing a pivot point for the bag holder 10 to be folded. The first lower support 16*a* and the second lower support 16*b* may have a curved shape.

Holes (not shown) may be placed on the bottom end 13*a* to allow the pivoting connection with the first lower support 16*a* and the second lower support 16*b*. The holes (not shown) may be located at a distance, for example, between approximately 2¼ and 2¾ inches from the center of the middle section 13*c*.

Relief cuts 28 (FIGS. 1-2) may be located on each end of the top ends 13*a*. The relief cuts 28 may provide additional space for the upper arms 14*a*, 14*b* to pivot against the top end 13*a*. The space may also provide additional room needed for opening the large plastic storage bag 24.

Upper spring clamps 18 may be secured to each one of the upper arms 14*a*, 14*b*. Lower spring clamps 20 may be secured to each one of the middle sections 13*c* of the support 12*a*, 12*b*. The upper spring clamps 18 and the lower spring clamps 20 may be a commercially available spring type damp. The upper spring clamps 18 and the lower spring clamps 20 may provide the proper tension to hold the plastic storage bags 24, 26. The upper spring clamps may be pivotably attached to the upper arms 14*a*, 14*b* to provide an anchor point for the large plastic storage bags 24 to be held open while being filled. The pressure for the upper spring clamps 18 holds the large plastic storage bag 24 in position.

In some embodiments, the upper spring clamps 18 and the lower spring clamps 20 may be a 3-sided clamp including a flange 30 that snap locks on the upper arms 14*a*, 14*b* and the middle sections 13*c* of the support 12*a*, 12*b*. The flange 30 may allow the upper spring clamps 18 and the lower spring clamps 20 to slide on the upper arms 14*a*, 14*b* and the middle sections 13*c*. The flange 30 may be, for example, between approximately ¼ and 3 inches long and between approximately ¼ and ¾ inches wide. The flange 30 may have a U-shape or a C-shape.

The lower spring clamps 20 may help in locking the small plastic storage bags 26 to the bag holder 10. The lower spring clamps 20 may slide on the middle section 13*c*. The lower spring clamps 20 may include angled tabs on the lower portion to help hold the small plastic storage bag 26 open.

A clamp mounting device 22 may be used to secure the spring clamps 18, 20 to the supports 13*a* or the upper arms 14*a*, 14*b*.

Figure 4:
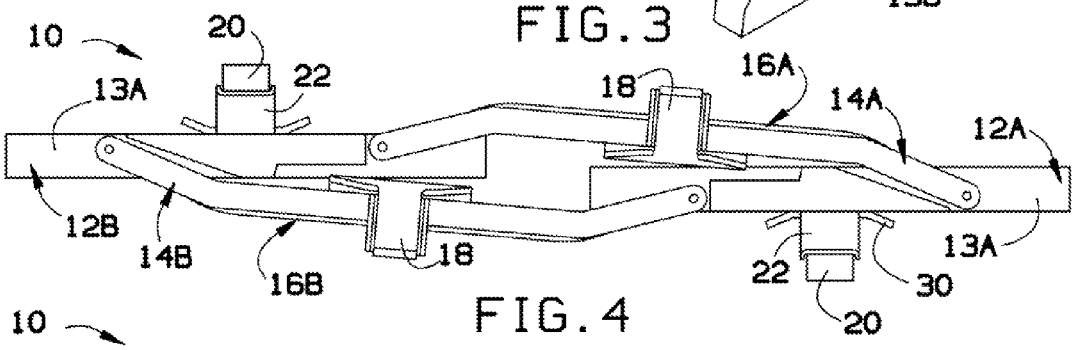
FIG. 4 is a top view of the bag holder of FIG. 1 showing the bag holder in a folded position.
Figure 5:
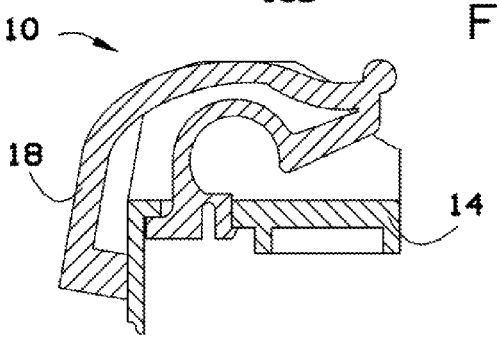
FIG. 5 is a cross section view of the bag holder taken along line 5-5 in FIG. 3.

FIG. 4 shows the bag holder 10 in a folded configuration. Pivoting the upper arms 14*a*, 14*b* and the lower support 16*a*, 16*b* against the supports 12*a*, 12*b* may produce the bag holder 10 to move from the open position to the folded position.

The user (not shown) may unfold the bag holder 10 and place the bottom ends 13*b* of the supports 12*a*, 12*b* on a stable surface (not shown). Then, the user may place the large plastic storage bag 24 between the upper arms 14*a*, 14*b* with the sides of the large plastic storage bag 24 towards the upper spring clamps 18. The user may open upper spring clamps 18, place one of the open sides of the large plastic storage bag 24, and close the upper spring clamps 18. Next, the user may repeat the process to secure the other open side of the large plastic storage bag 24 to the other upper spring clamps 18. The user may place the bottom of the large plastic storage bag 24 between the lower supports 16*a*, 16*b*, with the end resting on the stable surface. Then, the user may pour the food into the large plastic storage bag 24. The user may release the large plastic storage bag 24 from the upper spring clamps 18. The user may remove the large plastic storage bag 24 from the bag holder 10 and close the large plastic storage bag 24.

When using the small plastic storage bag 26, the user may lock one of the open sides of the small plastic storage bag 26 with the lower spring clamp 20. The user may place the bottom of the small plastic storage bag 26 resting on the stable surface. Then, the user may pour the food into the small plastic storage bag 26. The user may release the small plastic storage bag 26 from the lower spring clamps 20 and store the small plastic storage bag 26. The height of the lower spring clamp 20 may be adjusted by releasing the flange 30 to move the lower spring clamp 20 up or down.

The plastic storage bag holder 10 may be used in the mining industry, agricultural industry, and food packing industry. In addition, the plastic storage bag holder 10 may be used for filling sample bags, restaurants, food service, or pet stores for placing fish into plastic bags for temporary transportation.

It should be understood, of course, that the foregoing relates to exemplary embodiments of the invention and that modifications may be made without departing from the spirit and scope of the invention as set forth in the following claims.

What is claimed is:

1. A bag holder consisting of:

a first support having a top end, a bottom end, and a vertically extending middle section, said top end cantileveredly supported by the middle section;

a second support having a top end, a bottom end, and a vertically extending middle section, said top end cantileveredly supported by the middle section;

a first upper arm connecting the top end of the first support with the top end of the second support;

a second upper arm connecting the top end of the first support with the top end of the second support;

a first lower support pivotably connecting the bottom end of the first support with the bottom end of the second support with pivotable connections about a vertical axis;

a second lower support connecting the bottom end of the first support with the bottom end of the second support with pivotable connections about a vertical axis;

said first upper arm cantileveredly supported above the first lower support and said second upper arm cantileveredly supported above the second lower support; and clamps positioned opposed to one another, the clamps are secured to at least one of the first upper arm, the second upper arm, and the middle section of the first support and the second support; wherein the first upper arms and the first lower support are coplanar and the second upper arm and the second lower support are coplanar.

2. The bag holder according to claim 1, wherein the first support and the second support have a T-shape with the top ends connecting to the middle sections respectively.

3. The bag holder according to claim 1, wherein the first upper arm and the second upper arm are pivotably attached along axes extending perpendicularly to a horizontal plane containing the first and second upper arms to the top end of the first support and the top end of the second support.

4. The bag holder according to claim 1, wherein the first and second upper arms each have an angled portion.

5. The bag holder according to claim 1, wherein the bottom ends of the first support and the second support have a length that is greater than a length of the top ends of the first support and the second support.

6. The bag holder according to claim 1, wherein the first lower support and the second lower support are pivotably attached to the bottom ends of the first support and the second support along the vertical axes extending perpendicularly to a horizontal plane extending through the first and second lower supports.

7. The bag holder of claim 1 wherein the bottom ends of the first support and the second support have a length that is greater than a length of the top ends of the first support and the second support, a middle portion of each of the first and second upper arms are spaced further from the middle sections than ends of the first and second upper arms.

8. A bag holder consisting of:

a first support having a top end, a bottom end, and a vertically extending middle section, said top end cantileveredly supported by the middle section to be spaced above the bottom end;

a second support having a top end, a bottom end and, a vertically extending middle section, said top end cantileveredly supported by the middle section to be spaced above the bottom end;

at least one relief cut provided in each one of upper surfaces of the top ends of the first support and the second support;

a first upper arm connecting the top end of the first support with the top end of the second support;

a second upper arm connecting the top end of the first support with the top end of the second support;

clamps positioned opposed to one another, the clamps are secured to at least one of the first upper arm, the second upper arm, and the middle section of the first support and the second support the first upper arm and the second upper arm pivotably connected along vertical axes to the first and second supports to move the bag holder from an opened position with the first and second upper arms are spaced apart and parallel to one another to a folded position with the first and second upper arms together with the first and second supports at least partially coplanar; and wherein when in the folded position portions of the first and second arms nest directly above the at least one relief of the first and second supports respectively.

9. The bag holder according to claim 8, wherein each of the first support and the second support have a T-shape formed with the top end meeting the middle section.

* * * * *